US005292020A

United States Patent [19]

Narin

[11] Patent Number: 5,292,020

[45] Date of Patent: Mar. 8, 1994

[54] CLOSURE WITH ANTI-BACKOFF FEATURE

[75] Inventor: James F. Narin, St. Charles, IL

[73] Assignee: Phoenix Closures, Inc., Naperville, IL

[21] Appl. No.: 61,161

[22] Filed: May 13, 1993

[51] Int. Cl.[5] ..... B65D 41/04

[52] U.S. Cl. ..... 215/330; 215/331

[58] Field of Search ..... 215/329, 330, 331, 350, 215/351, 344; 220/296

[56] References Cited

U.S. PATENT DOCUMENTS 3,682,345 8/1972 Baugn .
3,871,545 3/1975 Bereziat .
3,963,139 6/1976 Gach .
3,979,001 9/1976 Bogert .
4,053,077 10/1977 DeFelice .
4,084,716 4/1978 Bogert .
4,461,394 12/1984 Sendel et al. .
4,697,715 10/1987 Beruvides ..... 215/330
4,736,859 4/1988 Mayes et al. ..... 215/330
4,913,299 4/1990 Petro .
5,197,621 3/1993 Bartl et al. ..... 215/331

*Primary Examiner*—Allan N. Shoap
*Assistant Examiner*—Nova Stucker
*Attorney, Agent, or Firm*—Welsh & Katz, Ltd.

[57] ABSTRACT

A backoff resistant closure for use with a container having a neck portion with container threads integrally formed thereon, the container threads having an uppermost portion. At least one protuberance is integrally formed on the inner surface of the annular skirt of the closure which projects inwardly. The protuberance is spaced from the uppermost segment of the closure threading and positioned between the uppermost segment of the closure threading and the inner face of the top portion of the closure. The protuberance is configured to abut and provide a frictional retaining force against the uppermost portion of the container threads. The protuberance will also retain a closure liner within the closure.

8 Claims, 1 Drawing Sheet

FIG. 1
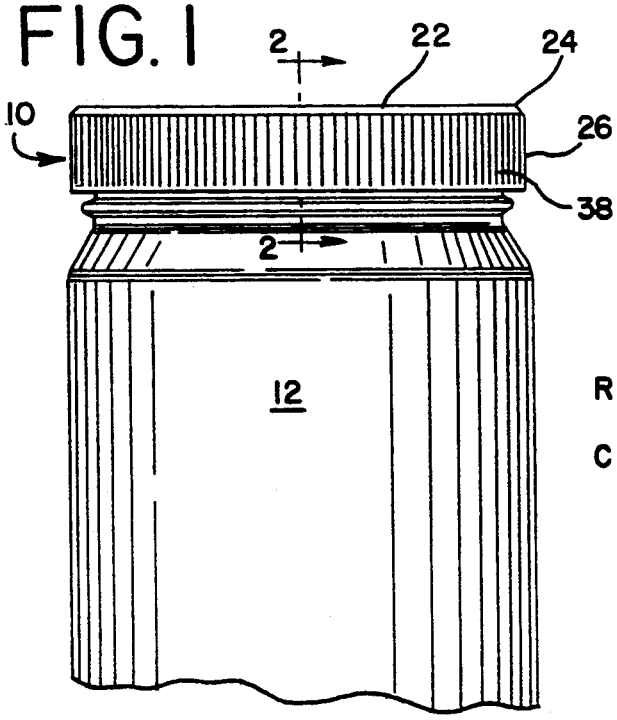
FIG. 2
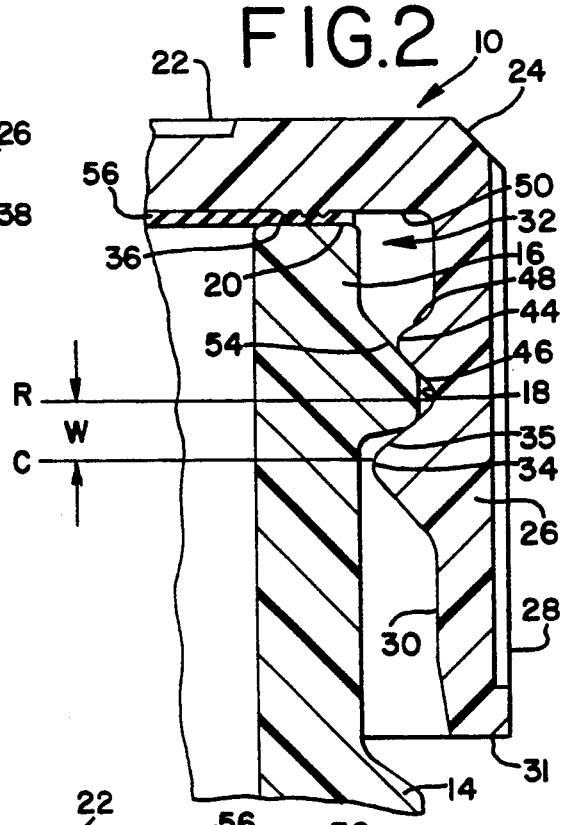
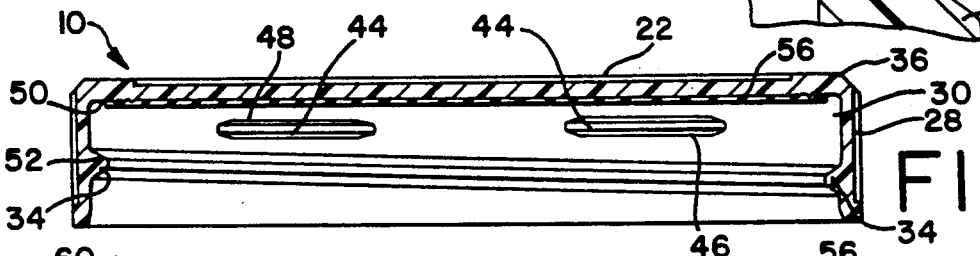
FIG. 3
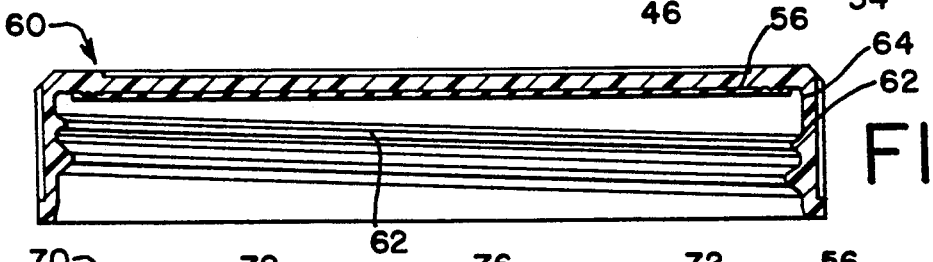
FIG. 4
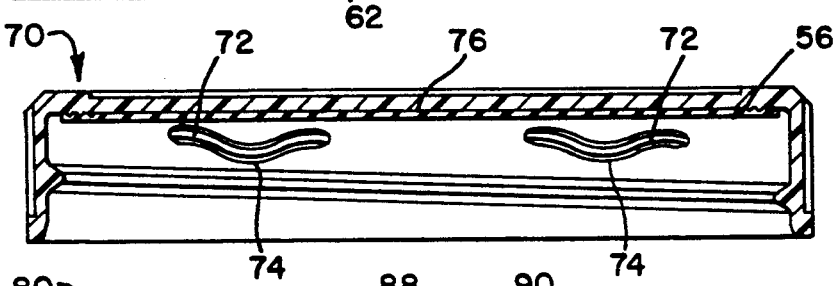
FIG. 5
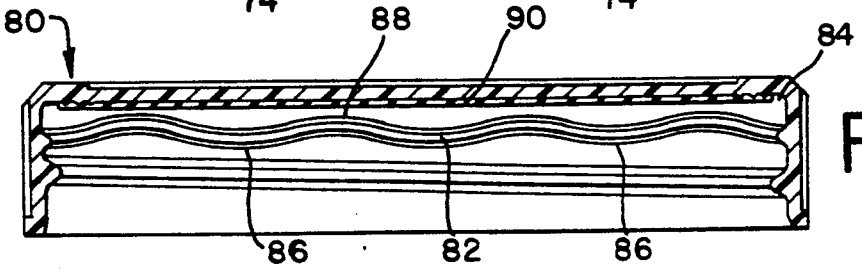
FIG. 6

CLOSURE WITH ANTI-BACKOFF FEATURE

The present invention relates to plastic closures for use on containers. More specifically, the present invention relates to a closure having at least one protuberance which provides a retaining force against the threads of the container to prevent loosening and backing off of the closure when the container and closure are in a closed position.

In containers using threaded closures where either the container or closure or both are made of a resilient plastic material, slippage or loosening of the closure from the container, normally classified as "backing off", can occur. This backoff effect is typically caused due to several factors. Resilient plastic materials inherently posses the ability to flow or creep under stress or pressure which results in a gradual loosening of the closure on the neck of the container. The closure may loosen from the container due to the internal pressure of the packaged product or pressures involved in air transport of the product. The low co-efficient of friction and self-lubricating qualities of plastic materials normally used in molding typical closures and containers can cause slippage. Minor manufacturing defects that occur during the molding process can create misalignment problems between the closure and the container that lead to backing off. Most commonly, with the above properties vibrations that occur during shipping and handling of the containers can cause the closure to backoff.

Backing off can be a significant problem to packagers in that containers having closures which are loose or appear to have been opened are less likely to be selected by consumers for fear of tampering or contamination. Further, the contents of the container can become spoiled and the product becomes unsalable, which results in a complete loss to the product manufacturer, distributor, or retailer. All in all, the effects of backing off can cost a manufacturing, packaging, distributing or retail business a substantial amount of money.

Thus far, most of the solutions to the costly problem of closure backoff have either failed or are too expensive, too inconvenient or too complicated to work in the closure cap and container manufacturing processes. Some of these solution include the addition of appendages which mate with the container, grooves or recesses, and a system of complementary ridges and recesses. These solutions typically require retooling and redesign of molding dies and stamping machinery, and therefore, are not acceptable to manufacturers. While many of the solutions and other types of closures have proved satisfactory in many respects, nevertheless, there is still a need for a container closure which provides a long term retention of the initial torque used to apply the closure to the container. The present invention provides such a closure assembly which resists subsequent loosening, or backing off, of the closure from the container.

To resolve the problems associated with the backing off effect of closures from containers noted above, the present invention provides a closure assembly which includes at least one protuberance which extends from the inner surface of the closure just above the threading but below the closure top to provide a frictional force against the upper-most portions of the container threads that retards axial movement of the closure.

SUMMARY OF THE INVENTION

It is therefore an object of the present invention to have a threaded closure construction which provides a tight, leak-proof closure.

It is a further object of the present invention to have a threaded closure construction which resists loosening during shipment or handling of the filled containers.

It is yet a further object of the present invention to provide a threaded closure assembly having an anti-backoff feature which is economical and easily adaptable to the closure cap and container manufacturing processes.

Accordingly, the foregoing objects are provided for in a molded backoff resistant closure and container combination including a container having a neck portion with container threads integrally formed thereon. The container threads have an uppermost portion. A closure having a generally planar top portion with an outer peripheral edge and an inner cavity is provided with the top portion having an inner face surface. An annular skirt depends from the peripheral edge which has an inner surface with integral closure threads configured and arranged to matingly engage the container threads. The closure threads have an uppermost segment. At least one projecting rib or protuberance is integrally formed on the inner surface of the annular skirt. The rib(s) are spaced away from the uppermost segment of the closure threading and positioned between the uppermost segment of the closure threading and the inner face of the top portion of the closure. The rib(s) are configured to abut against and provide a frictional retaining force to retard axial movement against the uppermost portion of the container threads. The rib(s) can also be configured to retain a closure liner up and within the inner cavity of the closure.

BRIEF DESCRIPTION OF THE DRAWINGS

Further objects of the invention, together with additional features contributing thereto and advantages occurring therefrom, will be apparent from the following description of the invention when read in conjunction with the accompanying drawings, wherein:

FIG. 1 depicts a frontal view of the container with the closure threaded thereon;

FIG. 2 depicts a partial cross-sectional view of the closure threaded onto the container and engaging the anti-backoff protuberance(s);

FIG. 3 depicts a cross-sectional view of the closure cap showing the preferred configuration of the protuberance(s);

FIG. 4 depicts a cross-sectional view depicting an alternative embodiment of the present invention wherein the protuberance(s) is substantially continuous and is slightly slanted;

FIG. 5 depicts a cross-sectional view of another alternative embodiment wherein the protuberance(s) is arcuately configured; and FIG. 6 depicts a cross-sectional view of yet another alternative embodiment wherein the protuberance(s) is arcuately configured and substantially continuous.

DETAILED DESCRIPTION OF THE INVENTION

Referring now to FIGS. 1 and 2, the closure of the present invention is designated generally at 10, and is shown mounted upon a container generally designated as 12. The container 12 has a shoulder portion 14 including a vertically projecting tubular neck portion 16 which extends to and terminates at a mouth portion 20. The neck portion 16 is also provided with a helical thread formation 18 which is integrally formed therewith. The container 12 is preferably manufactured of a thermoplastic polymeric material which is thermoformable, including, but not limited to, polyethylene and polypropylene.

The closure 10 is configured as a cap having a generally planar top portion 22 with an outer peripheral edge 24 and a depending annular skirt portion 26 depending from the edge 24. The skirt 26 includes an outer surface 28, an inner surface 30 and a lower edge 31. The top planar portion 22, skirt portion 26, outer surface 28 and inner surface 30 together form an inner cavity 32 of the closure 10. The inner surface 30 is provided with integral formed helical threads 34 which are designed to matingly engage threads 18 of the container 12. Accordingly, the threads 18 and 34 provide the means whereby the closure is secured to the container 12 in order to seal and protect the contents of the container 12.

The inner surface 30 may include a plurality of sealing ribs 36 which are configured and arranged to provide a more sealing engagement of the closure 10 against the mouth 20 of the container 12. The outer surface 28 may be provided with a plurality of vertical ribs 38 to allow the closure 10 to be installed upon the container 12 by automatic capping equipment as well as to facilitate gripping or manipulation of the closure 10 by the user.

Although the threads provided on the inner surface 30 of the closure 10 and the neck portion 16 of the container 12 are sufficient to initially secure the closure 10 upon the container 12 after the container 12 has been filled with a given contents, it is typically insufficient to prevent the closure 10 from "backing off" the container 12 during transportation and handling of the product. Increased torquing of the closure 10 to the container 12 will not solve the backoff problem. Instead, the increased torque can deform or damage the closure 10 or the container 12. Preventing backoff without damaging the closure 10 or container 12 is precisely the aim of the present invention.

To this end, referring more particularly to FIGS. 2 and 3, the present closure 10 includes at least one protuberance, rib or bead 44 formed on the inner surface 30. Typically, the rib 44 will be integrally formed with the closure 10 to provide for increased strength and ease of manufacture. The rib 44 has a first, or lower surface 46 and a second, or upper surface 48 relative to the top portion 22 of the closure 10. The rib or ribs 44 are preferably integrally formed with the inner surface 30, and specifically, located between the inner face 50 of the top portion 22 of the closure 10 and the uppermost region portion 52 of the threading 34 on the inner surface 30.

In the illustrated embodiment, as shown in FIGS. 2 and 3, the rib 44 should be positioned above the uppermost region 52 of the closure threading 34 approximately half the width of the container threading 18. The container threading width W is typically considered the depth of the threading which is measured from the root R of the thread to the crest C of the thread. This formula for the proper placement of the rib or ribs 44 is directed to insure that the uppermost portion 54 of the container threading 18 will abut the rib 44 correctly regardless of the size of the given closure and its corresponding container. It must be kept in mind, that the placement of the rib 44 between the closure threading 36 and the inner face 50 of the closure 10 is critical for producing the proper frictional engagement of the container threading 18 against the closure threading 36 and the rib 44. To this end, it has been determined that half the width of the container threading 18 is the most effective distance for placement of the rib 44 from the closure threading 36, although other distances are contemplated and may be equally effective to a specific closure and container type or size.

The rib 44 is configured and arranged to prevent the closure 10 from backing off the container 12 by engaging the container threading 18 between the uppermost region 35 of the closure threading 34 and thereby retard movement of the closure 10 on the container 12 due to vibrations in transit, slippage, or internal container pressure. The rib 44 achieves this result by increasing the torque required to remove the closure 10 from the container 12 and preventing upward or downward axial movement of the closure 10 when fully threaded onto the container 12.

In the embodiment shown in FIG. 3, there are at least two ribs 44. However, it is conceivable that the closure 10 could take on numerous configurations and include as few as one rib 44 or a plurality of ribs 44, as shown in FIGS. 3–6. The number of ribs 44 actually used will depend on the size of the closure 10 and the length of the ribs 44 themselves. Further, the ribs 44 can be equidistantly spaced apart or varied in their spacial relationship from one another. It is preferred that the ribs 44 are parallel to the inner face 50 of the closure to insure that they retard axial movement of the closure 10. By using ribs 44 that are parallel to the inner face 50, the ribs 44 create a uniform frictional holding force on the largest amount of surface area against the upper portion 54 of the container threading 18.

It is not required that the ribs 44 take on a linear shape, but they can be circular beads, triangularly shaped or other configurations to achieve the desired backoff function. All in all, the specific arrangement, shape and size of the ribs 44 can be varied while keeping within the principles disclosed herein.

Shown in FIGS. 4 through 6 are some of the more desirable alternative configurations of the present invention that achieve the desired anti-backoff effect. In FIG. 4 the rib 62 extends substantially around the circumference of the inner surface 64 of the closure 60. Rib 62 of this embodiment can be varied in length from that depicted in FIG. 4 to substantially travel around the full or partial circumference of the inner surface 64 of the closure 60. As will be explained in greater detail subsequent hereto, the length of the rib is particularly important in performing the function of retaining a liner 56 within the given closure, such as closures 10 and 60.

The embodiment depicted in FIG. 5 is a variation of the invention depicted in FIGS. 2 and 3, wherein the ribs 72 are curved or arched about the circumference of the inner surface 30 of the closure 70. The arcuate shape of the rib 70 is also important in the retainment of the liner 56 within the closure 10 in addition to performing the anti-backoff feature. The arcuately shaped rib 72 has a vertex point 74 which points away from the inner surface 76 of the closure 70. It is the vertex point 74 that comes in contact with the threading 34 of the container 12 to create the frictional retaining surface to prevent axial movement of the closure 70 and thereby help prevent backing off of the closure 70 from the container 12.

FIG. 6 depicts a closure 80 having another embodiment of the present invention in which the features shown in FIGS. 4 and 5 are combined to produce a substantially continuous rib 82 with a weave-like or arcuate shape. The rib 82 is formed on the inner surface 84 of the closure 80 and may extend as a continuous structure around the circumference of the inner surface 84. As with rib 62, here the rib 82 may also extend only partially around the inner surface 84. The rib 82 has lower vertex points 86 which like vertex point 74 of closure 70 creates the retaining surface against the threading 34 of the container 12 to prevent breaking off. In addition, rib 82 has an upper vertex point 88 which can be used to retain a liner 90 up within the closure 80.

In operation, the preferred embodiment of the present closure 10, including the ribs 44, is intended to perform an anti-backoff function whereby once the closure 10 is torqued onto the container 12 it is essentially locked on. However, an inherent secondary function of the closure 10 is that the ribs 44 also work to retain the sealing liner 56 in position within the closure 10. As shown in FIG. 3, the liner 56 is positioned above the upper surface 48 of the ribs 44 and is prevented from further downward movement beyond the ribs 44 due to the radial projection of the ribs 44 from the inner surface 30 of the closure 10. The ribs 44 act as a ledge beyond which the liner 56 is prevented from moving due to the extension of the ribs 44 beyond the periphery of the liner 56.

The positive retainment of the liner 56 within the closure 10 is an important feature because it facilitates the proper placement of the closure 10 and the liner 56 as a unit onto the container 12. Additionally, because the liner 56 is securely retained within the closure 10, above the ribs 44, it is less likely that the liner 56 will slip out from the closure 10 or become pinched or wedged between the closure 10 and the container 12 thereby preventing the proper engagement of the closure 10 onto the container 12. Furthermore, retainment of the liner 56 by the ribs 44, enables the closure manufacturer to package and distribute the closure 10 and liner 56 as a unit if so required or desirable to ship them apart or unconnected to the corresponding container 12. Also, the ribs 44 eliminate the need to use messy or harmful adhesives to retain the liner within a closure.

Referring particularly to FIG. 2, it is shown there how the present invention operates to prevent the backoff effect that so often plagues bottlers, manufacturers, and distributors. As shown, the uppermost region 54 of the threading 18 of the container 12, once fully threaded into the threads 34 of the closure 10, securely abuts against the lower surface 46 of the ribs 44 and is prevented from any further axial upward travel towards the top portion 22 of the closure 10. It should be understood that only one rib 44 is thus required to perform the anti-backoff function. The use of a plurality of ribs 44 will of course not detract from the anti-backoff feature, but is instead directed for use in retaining the liner 56 within the closure 10.

Essentially, the ribs 44 act as an upper barrier against which the uppermost portion 54 of the container threads 18 abut and also create a downward force against the container threads 18. This downward force against the container threads 18 is countered by the upward force of the helical configuration of the closure threads 34, thereby forcing the closure 10 to remain securely and firmly torqued onto the container 12. The ribs 44 not only cause the container threading 18 to be forced between the ribs 44 and the uppermost region 54 of the closure threading 18, but also forms a buttress against which the container 12 cannot travel up against. Because the container threads 18 are radially trapped from below by the threading 34 and above by the ribs 44, there is negligible area or space in which the container 12 can vibrate or otherwise move and thereby backoff.

Once the closure 10 is fully torqued onto the container 12, the closure 10 will be restrained from any movement that would otherwise cause the closure 10 to backoff the container 12. Further, because the liner 56 is securely stored within the closure 10, the liner 56 will not obstruct the proper application of the closure 10 to the container 12, nor in any way force the closure 10 away from the container 12 during transport or handling of the container 12.

While a particular embodiment and several alternative embodiments of the closure of the present invention have been shown and described, it will be appreciated by those in the art that changes and modifications may be made thereto without departing from the invention in its broader aspects and as set forth in the following claims.

I claim:

1. A backoff resistant closure and container combination, the combination comprising:

a container having a neck portion with container threads integrally formed thereon, said container threads having an uppermost portion;

a closure having a generally planar top portion with an outer peripheral edge and an inner face, an annular skirt depending from said peripheral edge, said skirt having an inner surface provided with integral closure threads configured and arranged to matingly engage said container threads, said closure threads having an uppermost region; and a plurality of protuberances integrally formed on the inner surface of said annular skirt, said protuberances being spaced from said uppermost region of said closure threads and positioned between said uppermost region of said closure threads and said inner face of said top portion of said closure, said protuberances abut against and provide a frictional retaining force against said uppermost portion of said container threads to prevent movement of said closure once secured onto said container, said protuberances being substantially equi-distantly spaced around said inner surface.

2. The closure and container combination as defined in claim 1 wherein said protuberances have an arcuate shape.

3. The closure and container combination as defined in claim 1 wherein said protuberances are parallel with respect to said top portion of said closure.

4. A closure cap for use with a corresponding container, the container having a neck portion with container threading having a predetermined thread width formed integrally thereon, the container neck having a mouth portion and an upper edge, the closure comprising:

a top panel having an outer face, a peripheral edge ad an inner face;

an annular skirt integrally depending from said peripheral edge, said skirt having an outer surface and an inner surface, said inner surface provided with integral closure threading that is configured and arranged to matingly engage the container threading when the closure is applied onto the container, said closure threading having an uppermost region being located nearest said inner face of the closure;

at least one rib formation integrally formed on said inner surface of the closure, said at least one rib formation comprising a plurality of arcuately shaped segments having vertex points in the axial direction of the closure cap;

said at least one rib formation fictionally engages the container threading to retard axial movement of the closure from the container and thereby prevent backing off of the closure when the closure is secured to the container; and said at least one rib formation being positioned below said inner face of said top panel of the closure and above said closure threading at a distance of approximately one-half the width of the container threading.

5. The closure as defined in claim 4 wherein a plurality of said ribs is utilized, said ribs being independently and substantially equi-distantly spaced apart on said inner surface of said closure.

6. The closure as defined in claim 4 wherein said at least one rib formation extends substantially around the circumference of said inner surface of said closure.

7. The closure as defined in claim 4 wherein said at lest one rib formation can retain a closure liner within said closure between said at least one rib formation and said inner face of said top panel.

8. A closure cap for use with a corresponding container, the container having a neck portion with container threading having a predetermined thread width formed integrally thereon, the container neck having a mouth portion and an upper edge, the closure comprising:

a top panel having an outer face, a peripheral edge and an inner face;

an annular skirt integrally depending from said peripheral edge, said skirt having an outer surface and an inner surface, said inner surface provided with integral closure threading that is configured and arranged to matingly engage the container threading when the closure is applied onto the container, said closure threading having an uppermost region being located nearest said inner face of the closure;

at least one rib formation integrally formed on said inner surface of the closure, aid at least one rib formation extending substantially around the circumference of said inner surface of said closure and comprising a plurality of arcuately shaped segments having vertex points in the axial direction of the closure cap.

said at least one rib formation frictionally engages the container threading to retard axial movement of the closure from the container and thereby prevent backing off of the closure when the closure is secured to the container; and said at least one rib formation being positioned below said inner face of said top panel of the closure and above said closure threading at a distance of approximately one-half the width of the container threading.

* * * * *

UNITED STATES PATENT AND TRADEMARK OFFICE

CERTIFICATE OF CORRECTION

PATENT NO. : 5,292,020

DATED : March 8, 1994

INVENTOR(S) : James F. Nairn

It is certified that error appears in the above-indentified patent and that said Letters Patent is hereby corrected as shown below:

On the Title Page, under Item [19], "Narin" should be --Nairn--, and in Item [75] "James F. Narin" should read --JAMES F. NAIRN--.

Signed and Sealed this

Twelfth Day of July, 1994

Bruce Lehman

*Attest:*

BRUCE LEHMAN

*Attesting Officer*

*Commissioner of Patents and Trademarks*